US008900511B2

(12) United States Patent
Ishikawa et al.

(10) Patent No.: US 8,900,511 B2
(45) Date of Patent: Dec. 2, 2014

(54) HIGH-STRENGTH NONMAGNETIC STAINLESS STEEL, AND HIGH-STRENGTH NONMAGNETIC STAINLESS STEEL PART AND PROCESS FOR PRODUCING THE SAME

(75) Inventors: Koichi Ishikawa, Nagoya (JP); Tetsuya Shimizu, Nagoya (JP)

(73) Assignee: Daido Tokushuko Kabushiki Kaisha, Nogoya, Aichi (JP)

( * ) Notice: Subject to any disclaimer, the term of this patent is extended or adjusted under 35 U.S.C. 154(b) by 0 days.

(21) Appl. No.: 12/149,482

(22) Filed: May 2, 2008

(65) Prior Publication Data

US 2008/0274007 A1 Nov. 6, 2008

(30) Foreign Application Priority Data

May 6, 2007 (JP) ..... 2007-121996

(51) Int. Cl.

| | |
|---|---|
| ***C22C 38/00*** | (2006.01) |
| ***C22C 38/08*** | (2006.01) |
| ***C22C 38/04*** | (2006.01) |
| ***C22C 38/18*** | (2006.01) |
| ***C22C 38/22*** | (2006.01) |
| ***E21B 17/10*** | (2006.01) |
| ***C22C 38/02*** | (2006.01) |
| ***C21D 9/00*** | (2006.01) |
| ***C22C 38/52*** | (2006.01) |
| ***C21D 9/02*** | (2006.01) |
| ***C22C 38/44*** | (2006.01) |
| ***C22C 38/58*** | (2006.01) |
| ***C22C 38/42*** | (2006.01) |
| ***C21D 9/28*** | (2006.01) |

(52) U.S. Cl.

CPC ..... *C22C 38/42* (2013.01); *C22C 38/02* (2013.01); *C21D 9/0093* (2013.01); *C22C 38/52* (2013.01); *C21D 9/02* (2013.01); *C22C 38/002* (2013.01); *C22C 38/44* (2013.01); *C22C 38/58* (2013.01); *C22C 38/001* (2013.01); *C21D 9/28* (2013.01)

USPC ..... 420/128; 420/123; 420/121; 420/119; 420/92; 420/91; 420/90; 420/89; 420/82; 420/76; 420/74; 420/73; 420/72; 420/65; 420/64; 420/61; 420/60; 420/34; 175/325.5; 175/325.4; 175/325.3; 175/325.2; 175/325.1

(58) Field of Classification Search

None

See application file for complete search history.

(56) References Cited

U.S. PATENT DOCUMENTS

| | | | | |
|---|---|---|---|---|
| 3,112,195 | A | 11/1963 | Souresny | |
| 3,904,401 | A | 9/1975 | Mertz et al. | |
| 4,434,006 | A * | 2/1984 | Kato et al. | 420/11 |
| 5,308,577 | A * | 5/1994 | Dulmaine et al. | 420/57 |
| 2002/0148537 | A1 * | 10/2002 | Koga et al. | 148/327 |

FOREIGN PATENT DOCUMENTS

| | | | | |
|---|---|---|---|---|
| DE | 1553841 | * | 6/1974 | C22C 39/18 |
| EP | 0987342 | | 3/2000 | |
| JP | 59-205451 | | 11/1984 | |
| JP | 60-013063 | | 1/1985 | |
| JP | 61-183451 | | 8/1986 | |
| JP | 61-210159 | | 9/1986 | |
| JP | 05-105987 | | 4/1993 | |
| JP | 05-195155 | | 8/1993 | |
| JP | 9041087 | A | 2/1997 | |
| JP | 2004156086 | A | 6/2004 | |
| WO | 91/16469 | A | 10/1991 | |

OTHER PUBLICATIONS

European Search Report in corresponding European Application No. EP 08 00 8528, dated Aug. 16, 2011.

* cited by examiner

*Primary Examiner* — Yoshitoshi Takeuchi

(74) *Attorney, Agent, or Firm* — Bacon & Thomas, PLLC

(57) ABSTRACT

The present invention relates a high-strength nonmagnetic stainless steel, containing, by weight percent, 0.01 to 0.06% of C, 0.10 to 0.50% of Si, 20.5 to 24.5% of Mn, 0.040% or less of P, 0.010% or less of S, 3.1 to 6.0% of Ni, 0.10 to 0.80% of Cu, 20.5 to 24.5% of Cr, 0.10 to 1.50% of Mo, 0.0010 to 0.0050% of B, 0.010% or less of O, 0.65 to 0.90% of N, and the remainder being Fe and inevitable impurities; the steel satisfying the following formulae (1) to (4):

$$[Cr]+3.3\times[Mo]+16\times[N]\geq 30 \quad (1),$$

$$\{Ni\}/\{Cr\}\geq 0.15 \quad (2),$$

$$2.0\leq[Ni]/[Mo]\leq 30.0 \quad (3), \text{ and}$$

$$[C]\times 1000/[Cr]\leq 2.5 \quad (4),$$

wherein [Cr], [Mo], [N], [Ni], [Mo] and [C] represent the content of Cr, the content of Mo, the content of N, the content of Ni, the content of Mo and the content of C in the steel, respectively, and {Ni} represents the sum of [Ni], [Cu] and [N], and {Cr} represents the sum of [Cr] and [Mo]. The present invention further relates to a high-strength nonmagnetic stainless steel part containing the steel and a process for producing the same.

12 Claims, No Drawings

HIGH-STRENGTH NONMAGNETIC STAINLESS STEEL, AND HIGH-STRENGTH NONMAGNETIC STAINLESS STEEL PART AND PROCESS FOR PRODUCING THE SAME

FIELD OF THE INVENTION

The invention relates to a high-strength nonmagnetic stainless steel, as well as a high-strength nonmagnetic stainless steel part and a process for producing the same. More specifically, it relates to a high-strength nonmagnetic stainless steel for use in a drill collar, a spring, a shaft, a bolt, a screw and the like, as well as a high-strength nonmagnetic stainless steel part and a process for producing the same.

BACKGROUND OF THE INVENTION

So far, when the oil drilling is carried out by the use of a drill, in order to magnetically detect a position of a drill at a leading end from on an earth surface to specify and control the position, a measurement device is installed in a drill collar close to a bit. At that time, in order to measure the orientation and inclination, since the earth magnetism has to be inhibited from affecting thereon, a nonmagnetic steel has to be used in the drill collar.

So far, in such an application, a high Mn nonmagnetic stainless steel such as 13Cr-18Mn-0.5Mo-2Ni-0.3N or 16.5Cr-16Mn-1Mo-1.3Ni-0.5Cu-0.4N has been used. Furthermore, various kinds of nonmagnetic stainless steels that are improved in terms of the corrosion resistance, the stress corrosion cracking, the strength, and the toughness as well as the nonmagnetism have been developed as well.

For instance, JP-A-05-195155 discloses a retaining ring material for the power generator which is constituted of a nonmagnetic iron-base alloy that contains, by weight percent, C: 0.04 to 0.06%, Mn: 19.39 to 19.83%, Cr: 19.68 to 20.12%, N: 0.616 to 0.674%, Mo: 1.44 to 1.62%, Ni: 0 to 2.97%, REM: 0 to 0.062% and the remainder being Fe and inevitable impurities.

This document describes that when a composition is set like this, the toughness and the corrosion resistance can be improved without damaging the strength.

Furthermore, JP-A-05-105987 discloses a retaining ring material for a power generator which is constituted of a nonmagnetic iron-base alloy that contains, by weight percent, C: 0.04 to 0.06%, Si: 0.49 to 0.58%, Mn: 19.38 to 19.87%, Ni: 0 to 2.83%, Cr: 19.65 to 20.18%, N: 0.612 to 0.705%, REM: 0.005 to 0.072% and the remainder being Fe and inevitable impurities.

This document discloses that when the REM is added, the toughness is inhibited from deteriorating.

Still furthermore, JP-A-60-13063 discloses an austenitic stainless steel for use in a very low temperature structure, which contains, by weight percent, C: 0.02 to 0.03%, N: 0.34 to 0.44%, Si: 0.48 to 0.70%, Cr: 16.5 to 22.0%, Ni: 9.0 to 17.5%, Mn: 4.5 to 13.2% and the remainder substantially being Fe, wherein Cr+0.9Mn satisfies 26.1 to 30.9% and the cleanness is in the range of 0.021 to 0.054.

This document describes that, when Cr and Mn are added in combination, the solubility of N may be increased and, when N is interstitially dissolved, the proof stress and toughness at very low temperature may be improved.

Furthermore, JP-A-59-205451 discloses a high-strength nonmagnetic steel obtained by subjecting, to a heat-treating and processing under prescribed conditions, a steel ingot that contains C: 0.057 to 0.135%, Si: 0.21 to 0.50%, Mn: 9.50 to 20.10%, Ni: 0.90 to 5.80%, Cr: 19.98 to 21.00%, Mo: 0.05 to 2.15%, N: 0.408 to 0.640% and the remainder substantially being Fe.

This document describes that, when, after the hot forging is applied, a processing is conducted at a temperature of 1000° C. or more at a processing rate of 10% or more, grains are fined and, when the processing is further conducted at a temperature in a range of 600 to 1000° C. at a processing rate of 10% or more, grains are fined and a carbonitride is precipitated finely.

Still furthermore, JP-A-61-183451 discloses a high-strength nonmagnetic steel that contains, by weight percent, Mn: 24.6 to 28.1%, Cr: 17.5 to 18.3%, V: 1.08 to 1.57%, C: 0.09 to 0.12%, N: 0.42 to 0.66%, Mo: 2.1 to 3.2%, Ni: 3.6 to 5.4% and the remainder being Fe and accompanying impurities.

This document describes that, when alloy elements are optimized, a nonmagnetic, high-strength and high corrosion resistance member is obtained.

Still furthermore, JP-A-61-210159 discloses a control rod driving unit for use in a nuclear power plant, which is constituted of an alloy containing, by weight percent, C: 0.09 to 0.12%, Mn: 24.6 to 28.1%, Cr: 17.5 to 18.3%, Ni: 3.6 to 5.4%, Mo: 2.1 to 3.2%, V: 1.21 to 1.57%, N: 0.42 to 0.66% and the remainder being Fe and accompanying impurities.

This document describes that, when alloy elements are optimized, the wear resistance and the corrosion resistance may be improved without the necessity of adding Co.

In the above-mentioned various kinds of nonmagnetic stainless steels, when alloy elements are optimized, the strength and the corrosion resistance may be improved to some extent. However, recently, demands for petroleum has been very strong and drilling areas has been various. Furthermore, a deeper drilling depth has been also demanded. Accordingly, for these applications, materials having higher strength and higher corrosion resistance has been demanded.

Furthermore, in general, as a material is made higher in the strength, the workability thereof tends to be poorer. However, in order to reduce the production costs of the various kinds of parts, the workability has to be improved while maintaining the high characteristics.

SUMMARY OF THE INVENTION

A purpose of the invention is to provide a high-strength nonmagnetic stainless steel excellent in the strength, corrosion resistance and workability, as well as a high-strength nonmagnetic stainless steel part employing the steel and a process for producing the same.

Namely, the present invention relates to the following items 1 to 11.

1. A high-strength nonmagnetic stainless steel, comprising:

by weight percent,
0.01 to 0.06% of C,
0.10 to 0.50% of Si,
20.5 to 24.5% of Mn,
0.040% or less of P,
0.010% or less of S,
3.1 to 6.0% of Ni,
0.10 to 0.80% of Cu,
20.5 to 24.5% of Cr,
0.10 to 1.50% of Mo,
0.0010 to 0.0050% of B,
0.010% or less of O,
0.65 to 0.90% of N, and the remainder being Fe and inevitable impurities;

said steel satisfying the following formulae (1) to (4):

$$[Cr]+3.3\times[Mo]+16\times[N]\geq 30 \quad (1),$$

$$\{Ni\}/\{Cr\}\geq 0.15 \quad (2),$$

$$2.0\leq[Ni]/[Mo]\leq 30.0 \quad (3), \text{ and}$$

$$[C]\times 1000/[Cr]\leq 2.5 \quad (4),$$

wherein [Cr], [Mo], [N], [Ni], [Mo] and [C] represent the content of Cr, the content of Mo, the content of N, the content of Ni, the content of Mo and the content of C in said steel, respectively, and {Ni} represents the sum of [Ni], [Cu] and [N], and {Cr} represents the sum of [Cr] and [Mo].

2. The high-strength nonmagnetic stainless steel according to item 1, further comprising:

at least one kind selected from the group consisting of Nb, V, W, Ta and Hf in an amount of 0.01 to 2.0% by weight.

3. The high-strength nonmagnetic stainless steel according to item 1, further comprising:

at least one kind selected from the group consisting of Ca, Mg and REM in an amount of 0.0001 to 0.010% by weight.

4. The high-strength nonmagnetic stainless steel according to item 2, further comprising:

at least one kind selected from the group consisting of Ca, Mg and REM in an amount of 0.0001 to 0.010% by weight.

5. The high-strength nonmagnetic stainless steel according to item 1, further comprising:

at least one kind selected from

Al in an amount of 0.001 to 0.10% by weight, and

Co in an amount of 0.01 to 2.0% by weight.

6. The high-strength nonmagnetic stainless steel according to item 2, further comprising:

at least one kind selected from

Al in an amount of 0.001 to 0.10% by weight, and

Co in an amount of 0.01 to 2.0% by weight.

7. The high-strength nonmagnetic stainless steel according to item 3, further comprising:

at least one kind selected from

Al in an amount of 0.001 to 0.10% by weight, and

Co in an amount of 0.01 to 2.0% by weight.

8. The high-strength nonmagnetic stainless steel according to item 4, further comprising:

at least one kind selected from

Al in an amount of 0.001 to 0.10% by weight, and

Co in an amount of 0.01 to 2.0% by weight.

9. A high-strength nonmagnetic stainless steel part, comprising the high-strength nonmagnetic stainless steel according to any one of items 1 to 8.

10. The high-strength nonmagnetic stainless steel part according to item 9, which is used as a drill collar, a spring, a shaft, a bolt or a screw.

11. A process for producing a high-strength nonmagnetic stainless steel part, comprising:

subjecting the high-strength nonmagnetic stainless steel according to any one of items 1 to 8 to a finish processing conducted at a surface temperature in a range of 500 to 900° C. and at an area reduction rate in a range of 15 to 60%.

In a high-strength nonmagnetic stainless steel according to the invention, since the amounts of Cr and Mn are increased more than those of conventional materials, a content of N may be increased. As a result, high strength may be obtained in comparison with the conventional materials.

On the other hand, when an amount of N is increased, it becomes difficult to obtain a structure made of an austenite single phase and the hot workability becomes deteriorated as well. However, according to the invention, since amounts of Ni and B are optimized simultaneously with an increase in a Cr amount and a Mn amount, the hot workability may be improved while maintaining the high strength, high corrosion resistance and nonmagnetism.

BEST MODE FOR CARRYING OUT THE INVENTION

In what follows, one embodiment of the invention will be detailed.

A high-strength nonmagnetic stainless steel according to the invention includes elements shown below and the remainder being Fe and inevitable impurities. The types of the addition elements, the component ratios thereof, the reason for limitation thereof, and the like are as follows. Herein, in the present specification, all the percentages defined by weight are the same as those defined by mass, respectively.

(1) C: 0.01 to 0.06% by Weight

An element C is indispensable as an austenite former and contributes to the strength. Accordingly, the content of C is preferably 0.01% by weight or more. The content of C is more preferably 0.03% by weight or more.

On the other hand, when the content of C is excessive, coarse carbide is precipitated to deteriorate the workability and the corrosion resistance. Accordingly, the content of C is preferably 0.06% by weight or less. The content of C is more preferably 0.05% by weight or less.

(2) Si: 0.10 to 0.50% by Weight

An element Si is added as a deoxidizer. In order to attain a sufficient deoxidizing effect, the content of Si is preferably 0.10% by weight or more. The content of Si is more preferably 0.20% by weight or more.

On the other hand, when the content of Si is excessive, the toughness is deteriorated to lower the hot workability of the steel. Accordingly, the content of Si is preferably 0.50% by weight or less. The content of Si is more preferably 0.40% by weight or less.

(3) Mn: 20.5 to 24.5% by Weight

An element Mn acts not only as a deoxidizer but also increases an amount of dissolved N. In order to secure a necessary amount of dissolved N, the content of Mn is preferably 20.5% by weight or more. The content of Mn is more preferably 21.0% by weight or more.

On the other hand, when Mn is excessively contained, the corrosion resistance becomes deteriorated. Accordingly, the content of Mn is preferably 24.5% by weight or less. The content of Mn is more preferably 23.0% by weight or less.

(4) P: 0.040% by Weight or Less

An element P segregates in a grain boundary to heighten the corrosion susceptibility of the grain boundary and deteriorate the toughness. Accordingly, the content of P is desirably as small as possible. On the other hand, when P is reduced more than necessary, it induces an increase in the cost. Accordingly, the content of P is preferably 0.040% by weight or less. The content of P is more preferably 0.030% by weight or less.

(5) S: 0.010% by Weight or Less

An element S deteriorates the hot workability. Accordingly, the content of S is preferably 0.010% by weight or less. Although it depends on a balance with the production cost, the content of S is more preferably 0.005% by weight or less.

(6) Ni: 3.1 to 6.0% by Weight

An element Ni is effective in improving the corrosion resistance, in particular, the corrosion resistance in a reducing acid environment. Furthermore, when Ni is added, an austenite single phase structure is obtained during the solution treatment. In order to obtain such an effect, the content of Ni is preferably 3.1% by weight or more. The content of Ni is more preferably 3.5% by weight or more.

On the other hand, when Ni is added excessively, it induces an increase in the cost. Accordingly, the content of Ni is preferably 6.0% by weight or less. The content of Ni is more preferably 5.0% by weight or less.

(7) Cu: 0.10 to 0.80% by Weight

An element Cu is effective in improving the corrosion resistance, in particular, the corrosion resistance in a reducing acid environment. Furthermore, Cu is also effective for obtaining an austenite single phase structure. In order to obtain such an effect, the content of Cu is preferably 0.10% by weight or more.

On the other hand, when Cu is added excessively, the hot workability becomes deteriorated. Accordingly, the content of Cu is preferably 0.80% by weight or less.

(8) Cr: 20.5 to 24.5% by Weight

An element Cr is an indispensable element for securing the corrosion resistance and acts so as to secure an amount of dissolved N. In order to attain such an effect, the content of Cr is preferably 20.5% by weight or more. The content of Cr is more preferably 21.0% by weight or more.

On the other hand, when an amount of Cr becomes excessive, the hot workability becomes deteriorated and the toughness becomes deteriorated as well. Accordingly, the content of Cr is preferably 24.5% by weight or less. The content of Cr is more preferably 23.0% by weight or less.

(9) Mo: 0.10 to 1.50% by Weight

An element Mo may impart necessary corrosion resistance and further improve the strength. In order to attain such an effect, the content of Mo is preferably 0.10% by weight or more. The content of Mo is more preferably 0.50% by weight or more.

On the other hand, when Mo is added excessively, the hot workability becomes deteriorated and the cost becomes increased. Accordingly, the content of Mo is preferably 1.50% by weight or less. The content of Mo is more preferably 1.0% by weight or less.

(10) B: 0.0010 to 0.0050% by Weight

An element B is an element effective for improving the hot workability of steel. Accordingly, the content of B is preferably 0.0010% by weight or more.

On the other hand, when B is excessively added, a nitride such as BN is generated to deteriorate the workability. Accordingly, the content of B is preferably 0.0050% by weight or less. The content of B is more preferably 0.0030% by weight or less.

(11) O: 0.010% by Weight or Less

An element O forms an oxide detrimental to the cold workability and the fatigue characteristics; accordingly, the content of O should be as small as possible. Accordingly, the content of O is preferably 0.010% by weight or less. Although a balance with the production cost has to be considered, the content of O is more preferably 0.007% by weight or less and still more preferably 0.005% by weight or less.

(12) N: 0.65 to 0.90% by Weight

An element N is added to obtain the nonmagnetism, high strength and excellent corrosion resistance. In order to attain such effects, the content of N is preferably 0.65% by weight or more. The content of N is more preferably 0.70% by weight or more.

On the other hand, when N is added excessively, a N blow is generated. Accordingly, the content of N is preferably 0.90% by weight or less. The content of N is more preferably 0.80% by weight or less.

In addition to containing the foregoing elements, the high-strength nonmagnetic stainless steel according to the invention necessarily satisfies the following conditions. In the followings, [Cr], [Mo], [N], [Ni], [Mo] and [C] represent the content of Cr, the content of Mo, the content of N, the content of Ni, the content of Mo and the content of C in the steel, respectively.

(A)<<PRE>>

The term <<PRE (Pitting Resistance Equivalent)>> is an index of the corrosion resistance and the value thereof necessarily satisfies the following formula (1). The larger the value of <<PRE>> is, the more excellent the corrosion resistance is.

$$<<PRE>>=[Cr]+3.3\times[Mo]+16\times[N]\geq 30 \quad (1)$$

In order to obtain sufficient corrosion resistance, the value of <<PRE>> is preferably 30 or more. In order to enable the steel to be used under more severe conditions, the value of <<PRE>> is preferably 35 or more.

(B) {Ni}/{Cr}

The ratio {Ni}/{Cr} is an index of the stability of an austenite phase and necessarily satisfies the following formula (2). The larger the ratio {Ni}/{Cr} is, the higher the stability of an austenite phase is. Herein, {Ni} denotes a Ni equivalent and {Cr} denotes a Cr equivalent.

$$\{Ni\}/\{Cr\}\geq 0.15 \quad (2)$$

(In the formula (2), {Ni} is sum of [Ni], [Cu] and [N], and {Cr} is sum of [Cr] and [Mo].)

According to the invention, Cr and Mo are added in order to secure sufficient corrosion resistance, whereby the stability of an austenite phase is lowered. Accordingly, in order to stabilize the austenite phase, {Ni} comparable to that may well be increased. In order to stabilize an austenite phase, the ratio {Ni})){Cr} is preferably 0.15 or more. The ratio {Ni}/{Cr} is more preferably 0.20 or more.

(C) [Ni]/[Mo]

The ratio [Ni]/[Mo] is a measure expressing a balance between the stability of an austenite phase and the corrosion resistance, and it necessarily satisfies the following formula (3).

$$2.0\leq[Ni]/[Mo]\leq 30.0 \quad (3)$$

An element Ni is necessary for the stabilization of an austenite phase and an element Mo is necessary for the corrosion resistance. When the content of Ni is excessive, the work hardening degree at the hot working is deteriorated and the strength is reduced. On the other hand, when the content of Ni is too small, an austenite phase becomes unstable.

Furthermore, when the content of Mo is excessive, an α-phase is generated to cause embrittlement. On the other hand, when the content of Mo is too small, sufficient corrosion resistance may not be obtained.

From the above reasons, the ratio [Ni]/[Mo] is preferably in the range of 2.0 to 30.0 and more preferably in the range of 3.0 to 15.0.

(D) [C]×1000/[Cr]

The value of [C]×1000/[Cr] is an index of the corrosion resistance and necessarily satisfies the following formula (4). The smaller the value of [C]×1000/[Cr] is, the more excellent the corrosion resistance is.

$$[C]\times 1000/[Cr]\leq 2.5 \quad (4)$$

An element C combines with Cr to form a carbide, whereby the content of Cr in a matrix is reduced and the corrosion resistance is deteriorated. In order to maintain excellent corrosion resistance, the value of [C]×1000/[Cr] is preferably 2.5 or less and more preferably 2.0 or less.

The high-strength nonmagnetic stainless steel according to the invention may further include, in addition to the elements, at least any one of the following elements.

(13) At Least One Kind of Nb, V, W, Ta and Hf: 0.01 to 2.0% by Weight

When Nb, V, W, Ta or Hf is added, carbides or carbonitrides are formed and grains of the steel are fined, whereby the toughness is heightened. In order to obtain such an effect, the content of at least one kind selected from the group consisting of Nb, V, W, Ta and Hf is preferably 0.01% by weight or more.

On the other hand, when the content thereof is excessive, the cost becomes increased. Accordingly, the content thereof is preferably 2.0% by weight or less and more preferably 1.0% by weight or less.

(14) At Least One Kind of Ca, Ma and REM: 0.0001 to 0.0100% by Weight

Elements Ca, Mg and REM are effective for improving the hot workability of the steel. In order to obtain such an effect, the content of at least one kind selected from the group consisting of Ca, Mg and REM is preferably 0.0001% by weight or more and more preferably 0.0005% by weight or more.

On the other hand, when the content thereof is excessive, the effect saturates and, contrary to the above, the hot workability is deteriorated. Accordingly, the content thereof is preferably 0.0100% by weight or less and more preferably 0.0050% by weight or less.

(15) Al: 0.001 to 0.10% by Weight

An element Al is a strong deoxidizer and is optionally added to reduce O as far as possible. In order to obtain such an effect, the content of Al is preferably 0.001% by weight or more.

On the other hand, when Al is added excessively, the hot workability is deteriorated. Accordingly, the content of Al is preferably 0.10% by weight or less, more preferably 0.050% by weight or less and still more preferably 0.010% by weight or less.

(16) Co: 0.01 to 2.0% by Weight

An element Co is effective for obtaining an austenite single phase structure. Furthermore, owing to the solution hardening, high strength may be obtained and the elastic modulus and rigidity modulus may be heightened. Accordingly, Co may be added according to the necessity. In order to obtain such an effect, the content of Co is set at 0.01% by weight or more.

On the other hand, when the content of Co is excessive, the cost becomes significantly increased. Accordingly, the content of Co is preferably 2.0% by weight or less and more preferably 0.5% by weight or less.

In this regard, with regard to each element contained in the steel of the invention, according to an embodiment, the minimal amount thereof present in the steel is the smallest nonzero amount used in the Examples of the developed steels as summarized in Table 1. According to a further embodiment, the maximum amount thereof present in the steel is the maximum amount used in the Examples of the developed steels as summarized in Table 1.

In the next place, a high-strength nonmagnetic stainless steel part according to the invention and a process for producing the same will be described.

A high-strength nonmagnetic stainless steel part according to the invention employs a high-strength nonmagnetic stainless steel of the invention. As parts to which the invention may be applied, specifically, a drill collar for use in oil drilling, a spring, a guide pin for use in a VTR, a motor shaft, a bolt, a screw and so on may be mentioned.

A high-strength nonmagnetic stainless steel part according to the invention can be produced according to a procedure shown below. That is, in the beginning, a raw material obtained by blending in a predetermined composition is melted and cast. In the next place, an ingot is subjected to hot forging, followed by being subjected to a solution treatment. Subsequently, it is subjected to a finish processing to thereby obtain a part. At that time, when the finish processing is applied under specific conditions, a part may be heightened in the strength.

In general, when a surface temperature of a steel material at the time of finish processing is too low, the deformation resistance becomes larger, whereby the processing becomes difficult. Accordingly, the surface temperature is set preferably at 500° C. or more.

On the other hand, when the surface temperature is too high, since the strain is released during the processing, high strength may not be obtained. Accordingly, the surface temperature is set preferably at 900° C. or less.

Furthermore, when the area reduction rate during the finish processing is too low, the work hardening becomes insufficient. Accordingly, the area reduction rate is set preferably at 15% or more, On the other hand, when the area reduction rate is too high, the deformation resistance becomes larger, whereby the processing becomes difficult. Accordingly, the area reduction rate is set preferably at 60% or less.

In the next place, functions of a high-strength nonmagnetic stainless steel, as well as a high-strength nonmagnetic stainless steel part and a process for producing the same in accordance with the invention will be described.

In a high-strength nonmagnetic stainless steel according to the invention, since the amounts of Cr and Mn are increased more than those of conventional materials, a content of N may be increased. As a result, high strength may be obtained in comparison with the conventional materials.

On the other hand, when an amount of N is increased, it becomes difficult to obtain a structure made of an austenite single phase and the hot workability becomes deteriorated as well. However, according to the invention, since amounts of Ni and B are optimized simultaneously with an increase in a Cr amount and a Mn amount, the hot workability may be improved while maintaining the high strength, high corrosion resistance and nonmagnetism.

Furthermore, in the case of employing a high-strength nonmagnetic stainless steel according to the invention to produce a part, when the finish processing is applied under specific conditions, high strength may be obtained due to the work hardening.

EXAMPLES

Examples 1 to 26 and Comparative Examples 1 to 9

1. Preparation of Samples

An ingot of 50 kg, which has a chemical composition shown in Table 1 or 2, was melted by the use of a high-frequency induction furnace and hot-forged into a rod material having a diameter of 20 mm. It was then subjected to a solution treatment at a temperature in the range of 1050 to 1150° C., followed by being subjected to a hot extrusion conducted at a temperature of 700° C. or 900° C. and at the area reduction rate of 30%.

TABLE 1

| | Composition (% by weight) | | | | | | | | | | |
|---|---|---|---|---|---|---|---|---|---|---|---|
| | C | Si | Mn | P | S | Cu | Ni | Cr | Mo | B | O |
| Example 1 | 0.03 | 0.18 | 23.1 | 0.002 | 0.001 | 0.21 | 5.2 | 20.8 | 0.78 | 0.0038 | 0.005 |
| Example 2 | 0.02 | 0.48 | 20.9 | 0.018 | 0.002 | 0.11 | 3.1 | 23.1 | 1.01 | 0.0014 | 0.008 |
| Example 3 | 0.04 | 0.25 | 21.7 | 0.028 | 0.005 | 0.38 | 3.4 | 21.9 | 0.23 | 0.0023 | 0.006 |
| Example 4 | 0.05 | 0.31 | 24.1 | 0.037 | 0.003 | 0.01 | 3.8 | 22.6 | 0.13 | 0.0027 | 0.004 |
| Example 5 | 0.03 | 0.28 | 23.4 | 0.011 | 0.030 | 0.10 | 4.1 | 24.2 | 0.78 | 0.0046 | 0.007 |
| Example 6 | 0.02 | 0.49 | 22.8 | 0.009 | 0.004 | 0.18 | 5.3 | 21.4 | 0.82 | 0.0013 | 0.003 |
| Example 7 | 0.03 | 0.32 | 21.3 | 0.025 | 0.002 | 0.42 | 3.8 | 22.8 | 0.90 | 0.0029 | 0.004 |
| Example 8 | 0.01 | 0.12 | 23.0 | 0.029 | 0.008 | 0.24 | 5.2 | 24.1 | 0.95 | 0.0028 | 0.007 |
| Example 9 | 0.05 | 0.46 | 22.9 | 0.032 | 0.005 | 0.39 | 4.8 | 23.3 | 1.03 | 0.0032 | 0.008 |
| Example 10 | 0.03 | 0.28 | 23.8 | 0.027 | 0.003 | 0.44 | 3.7 | 22.2 | 0.23 | 0.0048 | 0.009 |
| Example 11 | 0.05 | 0.29 | 23.1 | 0.023 | 0.003 | 0.36 | 3.5 | 22.9 | 0.19 | 0.0019 | 0.007 |
| Example 12 | 0.02 | 0.28 | 22.1 | 0.006 | 0.004 | 0.57 | 3.3 | 22.8 | 0.56 | 0.0024 | 0.005 |
| Example 13 | 0.04 | 0.33 | 21.9 | 0.027 | 0.002 | 0.35 | 4.8 | 23.1 | 0.10 | 0.0022 | 0.005 |
| Example 14 | 0.03 | 0.39 | 21.4 | 0.029 | 0.001 | 0.38 | 5.1 | 23.5 | 0.91 | 0.0020 | 0.004 |
| Example 15 | 0.04 | 0.22 | 20.6 | 0.020 | 0.005 | 0.38 | 3.6 | 20.3 | 1.47 | 0.0011 | 0.003 |
| Example 16 | 0.05 | 0.38 | 21.9 | 0.017 | 0.001 | 0.21 | 5.1 | 24.4 | 0.93 | 0.0034 | 0.001 |
| Example 17 | 0.05 | 0.24 | 20.8 | 0.032 | 0.002 | 0.37 | 4.9 | 21.7 | 0.94 | 0.0028 | 0.004 |
| Example 18 | 0.03 | 0.29 | 22.5 | 0.030 | 0.001 | 0.42 | 4.8 | 23.5 | 0.15 | 0.0032 | 0.002 |
| Example 19 | 0.04 | 0.27 | 23.1 | 0.028 | 0.003 | 0.33 | 3.6 | 23.2 | 0.93 | 0.0030 | 0.003 |
| Example 20 | 0.02 | 0.11 | 20.8 | 0.025 | 0.002 | 0.28 | 3.8 | 22.9 | 0.43 | 0.0029 | 0.003 |
| Example 21 | 0.04 | 0.22 | 22.5 | 0.025 | 0.001 | 0.40 | 4.7 | 22.8 | 0.12 | 0.0033 | 0.006 |
| Example 22 | 0.06 | 0.18 | 21.0 | 0.033 | 0.001 | 0.31 | 3.5 | 24.3 | 0.56 | 0.0041 | 0.004 |
| Example 23 | 0.03 | 0.28 | 21.8 | 0.029 | 0.002 | 0.37 | 3.8 | 23.9 | 1.02 | 0.0025 | 0.005 |
| Example 24 | 0.04 | 0.33 | 22.1 | 0.014 | 0.002 | 0.28 | 3.1 | 21.4 | 0.57 | 0.0016 | 0.006 |
| Example 25 | 0.01 | 0.47 | 24.2 | 0.027 | 0.003 | 0.20 | 5.8 | 23.3 | 0.63 | 0.0023 | 0.005 |
| Example 26 | 0.04 | 0.30 | 24.3 | 0.032 | 0.001 | 0.36 | 4.6 | 23.2 | 0.89 | 0.0026 | 0.003 |

| | Composition (% by weight) | | | | | | |
|---|---|---|---|---|---|---|---|
| | N | Ca, Mg, REM | Nb, W, V, Ta, Hf, Co | Al | {Ni}/{Cr} | <<PRE>> | C/Cr × 1000 |
| Example 1 | 0.76 | Ca: 0.0017 | Nb: 0.38, Co: 0.40 | 0.003 | 0.29 | 35.5 | 1.4 |
| Example 2 | 0.73 | | W: 0.65 | 0.002 | 0.16 | 38.1 | 0.9 |
| Example 3 | 0.71 | | | 0.002 | 0.20 | 34.0 | 1.8 |
| Example 4 | 0.80 | Mg: 0.0021 | | 0.004 | 0.20 | 35.8 | 2.2 |
| Example 5 | 0.86 | REM: 0.0019 | W: 0.48 | 0.005 | 0.20 | 40.5 | 1.2 |
| Example 6 | 0.69 | Ca: 0.0020 | | 0.004 | 0.28 | 35.1 | 0.9 |
| Example 7 | 0.79 | | | 0.003 | 0.21 | 38.4 | 1.3 |
| Example 8 | 0.85 | | V: 0.78, Co: 0.78 | 0.002 | 0.25 | 40.8 | 0.4 |
| Example 9 | 0.79 | Mg: 0.0012 | | 0.005 | 0.25 | 39.3 | 2.1 |
| Example 10 | 0.81 | | | 0.003 | 0.22 | 35.9 | 1.4 |
| Example 11 | 0.74 | | | 0.002 | 0.20 | 35.4 | 2.2 |
| Example 12 | 0.72 | | Ta: 0.52 | 0.004 | 0.20 | 36.2 | 0.9 |
| Example 13 | 0.78 | | Co: 1.34 | 0.001 | 0.26 | 35.9 | 1.7 |
| Example 14 | 0.83 | | | 0.003 | 0.26 | 39.8 | 1.3 |
| Example 15 | 0.66 | | V: 0.39 | 0.002 | 0.21 | 35.7 | 2.0 |
| Example 16 | 0.78 | | Co: 0.53 | 0.001 | 0.24 | 39.9 | 2.0 |
| Example 17 | 0.67 | | | 0.002 | 0.26 | 35.5 | 2.3 |
| Example 18 | 0.79 | REM: 0.0010 | | 0.004 | 0.25 | 36.6 | 1.3 |
| Example 19 | 0.77 | | | 0.001 | 0.19 | 38.6 | 1.7 |
| Example 20 | 0.68 | | W: 0.41 | 0.003 | 0.20 | 35.2 | 0.9 |
| Example 21 | 0.80 | | | 0.002 | 0.26 | 36.0 | 1.8 |
| Example 22 | 0.72 | | | 0.004 | 0.18 | 37.7 | 2.5 |
| Example 23 | 0.81 | | | 0.001 | 0.20 | 40.2 | 1.3 |
| Example 24 | 0.73 | Ca: 0.0009 | Co: 1.77 | 0.003 | 0.19 | 35.0 | 1.9 |
| Example 25 | 0.88 | | Hf: 0.19 | 0.002 | 0.29 | 39.5 | 0.4 |
| Example 26 | 0.89 | | | 0.001 | 0.24 | 40.4 | 1.7 |

TABLE 2

| | Composition (% by weight) | | | | | | | | | | | | | | | | |
|---|---|---|---|---|---|---|---|---|---|---|---|---|---|---|---|---|---|
| | C | Si | Mn | P | S | Cu | Ni | Cr | Mo | B | O | N | Ca, Mg, REM | Nb, W, V, Ta, Hf, Co | Al | {Ni}/{Cr} | <<PRE>> | C/Cr × 1000 |
| Comparative Example 1 | 0.04 | 0.33 | 21.9 | 0.023 | 0.003 | 0.32 | 1.5 | 23.8 | 0.02 | 0.0012 | 0.013 | 0.96 | | | | 0.12 | 39.2 | 1.7 |

TABLE 2-continued

| | Composition (% by weight) | | | | | | | | | | | | | | | | | |
|---|---|---|---|---|---|---|---|---|---|---|---|---|---|---|---|---|---|---|
| | C | Si | Mn | P | S | Cu | Ni | Cr | Mo | B | O | N | Ca, Mg, REM | Nb, W, V, Ta, Hf, Co | Al | {Ni}/{Cr} | <<PRE>> | C/Cr × 1000 |
| Comparative Example 2 | 0.05 | 0.43 | 20.7 | 0.019 | 0.004 | 0.26 | 3.9 | 21.8 | 0.23 | 0.0037 | 0.009 | 0.57 | | | | 0.21 | 31.7 | 2.3 |
| Comparative Example 3 | 0.07 | 0.29 | 22.1 | 0.027 | 0.002 | 0.23 | 2.7 | 25.8 | 0.03 | — | 0.014 | 0.80 | | | | 0.14 | 38.7 | 2.7 |
| Comparative Example 4 | 0.03 | 0.30 | 21.6 | 0.032 | 0.005 | 0.16 | 4.3 | 19.4 | 0.41 | — | 0.008 | 0.71 | | | | 0.26 | 32.1 | 1.5 |
| Comparative Example 5 | 0.02 | 0.27 | 20.9 | 0.038 | 0.003 | 0.09 | 2.1 | 23.1 | 0.36 | 0.0067 | 0.010 | 0.75 | | | | 0.13 | 36.3 | 0.9 |
| Comparative Example 6 | 0.04 | 0.19 | 22.4 | 0.026 | 0.002 | 0.12 | 1.9 | 21.5 | 0.22 | — | 0.009 | 0.68 | | | | 0.12 | 33.1 | 1.9 |
| Comparative Example 7 | 0.11 | 0.30 | 24.6 | 0.025 | 0.001 | 0.19 | 3.6 | 17.5 | 2.20 | — | — | 0.42 | | | | 0.21 | 31.5 | 6.3 |
| Comparative Example 8 | 0.06 | 0.25 | 15.5 | 0.023 | 0.002 | 0.14 | 4.1 | 20.1 | 1.50 | — | — | 0.57 | | | | 0.22 | 34.1 | 3.0 |
| Comparative Example 9 | 0.03 | 0.23 | 15.5 | 0.027 | 0.001 | 0.11 | 9.0 | 19.0 | 0.45 | — | — | 0.44 | | | | 0.49 | 27.5 | 1.6 |

2. Test Method

A hot-extruded material was processed into various test pieces and the test pieces were then subjected to the following tests.

(1) Tensile Strength, 0.2% Proof Stress and Elastic Modulus

The tensile strength, 0.2% proof stress and elastic modulus were obtained as the fracture stress when a tensile load was applied, the stress when the strain of 0.2% was generated and a gradient (elastic modulus) within an elastic region, respectively, according to a test using a JIS No. 4 test piece, which was in accordance with JIS-Z2241.

(2) Impact Value

The impact test was carried out using a JIS No. 42-mm V-notch test piece in accordance with JIS-Z2242.

(3) Magnetic Permeability

The magnetic permeability was measured with an external magnetic field set at 200 [Oe] in accordance with a VSM method.

(4) Corrosion Resistance

The corrosion resistance was evaluated in accordance with JIS-G0575 (sulfuric acid-copper sulfate corrosion bending test) by dipping a planar test piece having a size of 20 mm×70 mm×5 mm thickness in a sulfuric acid-copper sulfate corrosion solution. The bending angle was set at 150°. As a result, one that was not fractured was evaluated as "good" and one in which fracture was found was evaluated as "poor".

(5) Productivity

Whether the nitrogen blow was found in the ingot or not was investigated.

Furthermore, the squeeze at 1000° C. of the hot high-speed tensile test was measured. One of which squeeze was 60% or more was judged as having excellent workability and expressed by "good".

3. Test Result

In tables 3 and 4, test results are shown.

In comparative example 1, since the amount of nitrogen is excessive, the N blow was caused. In comparative example 2, since the amount of N is small, the strength was low and the magnetic permeability was high. In comparative example 3, since the amount of Cr is excessive, the magnetic permeability was high and the corrosion resistance was low. In comparative example 4, since the amount of Cr is small, the N blow was caused. In comparative example 5, since the amount of B is excessive, the magnetic permeability was high and the hot workability was poor. In comparative example 6, since B is not added and the ratio {Ni}/{Cr} is low, the magnetic permeability was high and the hot workability was poor. In comparative examples 7 and 8, since the value of [C]×1000/[Cr] is high, the strength was low and the corrosion resistance was poor. In comparative example 9, since the amount of N is small and the value of <<PRE>> is low, the strength was low and the corrosion resistance was low.

On the other hand, in examples 1 through 26, since the component elements are optimized, excellent hot workability was obtained while maintaining high strength, high corrosion resistance and nonmagnetism.

TABLE 3

| | Productivity | | Hot Working at 700° C. | | | | | | Hot Working at 900° C. | | | | | |
|---|---|---|---|---|---|---|---|---|---|---|---|---|---|---|
| | N Blow | Hot Workability | Tensile Strength (MPa) | 0.2% Proof Stress (MPa) | Elastic Modulus (GPa) | Magnetic Permeability | Charpy Impact Value (J/cm$^2$) | Sulfuric Acid-Copper Sulfate Bending | Tensile Strength (MPa) | 0.2% Proof Stress (MPa) | Elastic Modulus (GPa) | Magnetic Permeability | Charpy Impact Value (J/cm$^2$) | Sulfuric Acid-Copper Sulfate Bending |
| Example 1 | absent | good | 1408 | 1298 | 178 | 1.004 | 117 | good | 1312 | 1208 | 177 | 1.003 | 137 | good |
| Example 2 | absent | good | 1344 | 1232 | 171 | 1.007 | 118 | good | 1267 | 1187 | 170 | 1.008 | 141 | good |
| Example 3 | absent | good | 1367 | 1255 | 172 | 1.008 | 121 | good | 1275 | 1190 | 169 | 1.007 | 135 | good |
| Example 4 | absent | good | 1423 | 1318 | 170 | 1.003 | 119 | good | 1343 | 1217 | 171 | 1.002 | 149 | good |

TABLE 3-continued

| | Productivity | | Hot Working at 700° C. | | | | | | Hot Working at 900° C. | | | | | |
|---|---|---|---|---|---|---|---|---|---|---|---|---|---|---|
| | N Blow | Hot Work-ability | Tensile Strength (MPa) | 0.2% Proof Stress (MPa) | Elastic Modu-lus (GPa) | Mag-netic Perme-ability | Charpy Impact Value (J/cm$^2$) | Sulfuric Acid-Copper Sulfate Bending | Tensile Strength (MPa) | 0.2% Proof Stress (MPa) | Elastic Modu-lus (GPa) | Magnetic Perme-ability | Charpy Impact Value (J/cm$^2$) | Sulfuric Acid-Copper Sulfate Bending |
| Example 5 | absent | good | 1472 | 1364 | 172 | 1.002 | 125 | good | 1378 | 1231 | 172 | 1.002 | 139 | good |
| Example 6 | absent | good | 1365 | 1249 | 169 | 1.004 | 119 | good | 1279 | 1179 | 168 | 1.003 | 138 | good |
| Example 7 | absent | good | 1399 | 1286 | 173 | 1.002 | 115 | good | 1303 | 1201 | 172 | 1.002 | 144 | good |
| Example 8 | absent | good | 1455 | 1332 | 182 | 1.002 | 122 | good | 1375 | 1248 | 181 | 1.003 | 137 | good |
| Example 9 | absent | good | 1423 | 1310 | 172 | 1.003 | 110 | good | 1322 | 1222 | 171 | 1.002 | 140 | good |
| Example 10 | absent | good | 1411 | 1303 | 169 | 1.003 | 120 | good | 1318 | 1202 | 170 | 1.002 | 142 | good |
| Example 11 | absent | good | 1378 | 1256 | 170 | 1.004 | 117 | good | 1299 | 1196 | 169 | 1.005 | 139 | good |
| Example 12 | absent | good | 1361 | 1243 | 170 | 1.006 | 124 | good | 1256 | 1162 | 171 | 1.005 | 141 | good |
| Example 13 | absent | good | 1422 | 1311 | 184 | 1.003 | 121 | good | 1321 | 1213 | 185 | 1.002 | 148 | good |
| Example 14 | absent | good | 1444 | 1338 | 171 | 1.002 | 120 | good | 1354 | 1232 | 170 | 1.003 | 141 | good |
| Example 15 | absent | good | 1352 | 1239 | 172 | 1.007 | 118 | good | 1245 | 1167 | 171 | 1.008 | 139 | good |
| Example 16 | absent | good | 1401 | 1289 | 179 | 1.003 | 117 | good | 1302 | 1198 | 180 | 1.002 | 140 | good |
| Example 17 | absent | good | 1332 | 1223 | 169 | 1.007 | 120 | good | 1243 | 1159 | 169 | 1.006 | 142 | good |
| Example 18 | absent | good | 1406 | 1308 | 170 | 1.002 | 119 | good | 1312 | 1207 | 168 | 1.003 | 144 | good |
| Example 19 | absent | good | 1433 | 1310 | 171 | 1.003 | 122 | good | 1328 | 1206 | 170 | 1.002 | 138 | good |
| Example 20 | absent | good | 1386 | 1279 | 170 | 1.006 | 118 | good | 1276 | 1188 | 172 | 1.007 | 139 | good |
| Example 21 | absent | good | 1405 | 1298 | 172 | 1.002 | 120 | good | 1310 | 1210 | 171 | 1.002 | 142 | good |
| Example 22 | absent | good | 1352 | 1237 | 171 | 1.005 | 121 | good | 1266 | 1175 | 170 | 1.004 | 138 | good |
| Example 23 | absent | good | 1432 | 1322 | 171 | 1.002 | 125 | good | 1336 | 1230 | 170 | 1.003 | 140 | good |
| Example 24 | absent | good | 1475 | 1366 | 185 | 1.005 | 122 | good | 1381 | 1257 | 184 | 1.004 | 139 | good |
| Example 25 | absent | good | 1389 | 1272 | 170 | 1.002 | 120 | good | 1298 | 1201 | 169 | 1.003 | 141 | good |
| Example 26 | absent | good | 1438 | 1329 | 169 | 1.002 | 119 | good | 1351 | 1248 | 170 | 1.002 | 133 | good |

TABLE 4

| | Productivity | | Hot Working at 700° C. | | | | | | Hot Working at 900° C. | | | | | |
|---|---|---|---|---|---|---|---|---|---|---|---|---|---|---|
| | N Blow | Hot Work-ability | Tensile Strength (MPa) | 0.2% Proof Stress (MPa) | Elastic Modu-lus (GPa) | Mag-netic Perme-ability | Charpy Impact Value (J/cm$^2$) | Sulfuric Acid-Copper Sulfate Bending | Tensile Strength (MPa) | 0.2% Proof Stress (MPa) | Elastic Modu-lus (GPa) | Magnetic Perme-ability | Charpy Impact Value (J/cm$^2$) | Sulfuric Acid-Copper Sulfate Bending |
| Comparative Example 1 | present | poor | — | — | — | — | — | — | — | — | — | — | — | — |
| Comparative Example 2 | absent | good | 1023 | 912 | 171 | 1.017 | 161 | good | 952 | 843 | 170 | 1.019 | 187 | good |
| Comparative Example 3 | absent | good | 1421 | 1308 | 180 | 1.023 | 124 | poor | 1322 | 1214 | 176 | 1.022 | 147 | poor |
| Comparative Example 4 | present | poor | — | — | — | — | — | — | — | — | — | — | — | — |
| Comparative Example 5 | absent | poor | 1398 | 1276 | 169 | 1.018 | 119 | good | 1299 | 1176 | 168 | 1.022 | 139 | good |
| Comparative Example 6 | absent | poor | 1321 | 1209 | 170 | 1.021 | 121 | good | 1243 | 1134 | 169 | 1.023 | 143 | good |
| Comparative Example 7 | absent | good | 953 | 822 | 178 | 1.005 | 172 | poor | 834 | 711 | 173 | 1.004 | 139 | poor |
| Comparative Example 8 | absent | good | 1101 | 967 | 173 | 1.007 | 160 | poor | 947 | 821 | 170 | 1.003 | 179 | poor |
| Comparative Example 9 | absent | good | 989 | 832 | 169 | 1.003 | 172 | poor | 856 | 726 | 172 | 1.002 | 141 | poor |

While the present invention has been described in detail and with reference to specific embodiments thereof, it will be apparent to one skilled in the art that various changes and modifications can be made therein without departing from the spirit and scope thereof.

The present application is based on Japanese Patent Application No. 2007-121996 filed on May 6, 2007, the contents thereof being incorporated herein by reference.

What is claimed is:

1. A drill collar for oil drilling comprising a high-strength nonmagnetic stainless steel, consisting of:

by weight percent, 0.01 to 0.06% of C, 0.10 to 0.50% of Si, 21.0 to 24.5% of Mn, 0.040% or less of P, 0.010% or less of S, 3.1 to 6.0% of Ni, 0.10 to 0.80% of Cu, 20.5 to 24.5% of Cr, 0.10 to 1.50% of Mo, 0.0010 to 0.0050% of B, 0.010% or less of O, 0.65 to 0.90% of N, at least one element selected from th grouip consisting of Ca and Mg, said at least one element present in an amount of 0.001 to 0.10% , and the remainder being Fe and inevitable impurities;

wherein said steel composition satisfies the following formulae (1) to (4):

$$[Cr]+3.3\times[Mo]+16\times[N]\geq 30 \quad (1),$$

$$\{Ni\}/\{Cr\}\geq 0.15 \quad (2),$$

$$2.0\leq[Ni]/[Mo]\leq 30.0 \quad (3), \text{ and}$$

$$[C]\times 1000/[Cr]\leq 2.5 \quad (4),$$

wherein [Cr], [Mo], [N], [Ni], and [C] represent the content of Cr, the content of Mo, the content of N, the content of Ni, and the content of C in said steel, respectively, and {Ni} represents the sum of [Ni], [Cu] and [N], and {Cr} represents the sum of [Cr] and [Mo];

wherein said nonmagnetic stainless steel has a magnetic permeability of 1.003-1.004; and, wherein said nonmagnetic stainless steel has tensile strength of 1279-1475 MPa.

2. The drill collar for oil drilling comprising a high-strength nonmagnetic stainless steel according to claim 1, further comprising:

at least one element selected from the group consisting of Nb, V, W, Ta And Hf in an amount of 0.01 to 2.0% by weight.

3. The drill collar for oil drilling comprising a high-strength nonmagnetic stainless steel according to claim 1, further comprising:

at least one element selected from the group consisting of Al in an amount of 0.001 to 0.10% by weight, and Co in an amount of 0.01 to 2.0% by weight.

4. The drill collar for oil drilling comprising a high-strength nonmagnetic stainless steel according to claim 2, further comprising:

at least one element selected from the group consisting of Al in an amount of 0.001 to 0.10% by weight, and Co in an amount of 0.01 to 2.0% by weight.

5. A drill collar for oil drilling comprising a high-strength nonmagnetic stainless steel part, comprising the high-strength nonmagnetic stainless steel according to claim 1.

6. The drill collar for oil drilling comprising a high-strength nonmagnetic stainless steel part according to claim 5, wherein the high-nonmagnetic stainless steel further comprising:

at least one element selected from the group consisting of Nb, V, W, Ta and Hf in an amount of 0.01 to 2.0% by weight.

7. The drill collar for oil drilling comprising a high-strength nonmagnetic stainless steel part according to claim 5, wherein the high-strength nonmagnetic stainless steel further comprising:

at least one element selected from the group consisting of Al in an amount of 0.001 to 0.10% by weight, and Co in an amount of 0.01 to 2.0% by weight.

8. The drill collar for oil drilling comprising a high-strength nonmagnetic stainless steel part according to claim 6, wherein the high-strength nonmagnetic stainless steel further comprising:

at least one element selected from the group consisting of Al in an amount of 0.001 to 0.10% by weight, and Co in an amount of 0.01 to 2.0% by weight.

9. The drill collar for oil drilling comprising a high-strength nonmagnetic stainless steel according to claim 1, wherein Mg is present.

10. The drill collar for oil drilling comprising a high-strength nonmagnetic stainless steel according to claim 1, wherein Ca is present.

11. The drill collar for oil drilling comprising a high-strength nonmagnetic stainless steel according to claim 9, wherein the amount Mg is from 0.0005 to 0.005%.

12. The drill collar for oil drilling comprising a high-strength nonmagnetic stainless steel according to claim 10, wherein the amount Ca is from 0.0005 to 0.005%.

* * * * *